US006675706B2

(12) United States Patent
Barker et al.

(10) Patent No.: US 6,675,706 B2
(45) Date of Patent: Jan. 13, 2004

(54) DAMPENING ASSEMBLY HAVING AIR SEAL APPARATUS FOR SEALING DAMPENING SOLUTION

(76) Inventors: Dean A. Barker, P.O. Box 862, Belvidere, IL (US) 61008; Terrence Hatch, 7410 Scott La., Machesney Park, IL (US) 61015

( * ) Notice: Subject to any disclaimer, the term of this patent is extended or adjusted under 35 U.S.C. 154(b) by 0 days.

(21) Appl. No.: 09/766,460

(22) Filed: Jan. 19, 2001

(65) Prior Publication Data

US 2002/0096065 A1 Jul. 25, 2002

(51) Int. Cl.[7] ..... B41L 25/00; B41F 7/24
(52) U.S. Cl. ..... 101/148; 101/147; 101/363
(58) Field of Search ..... 101/147, 148, 101/363, 364, 204, 207, 208, 210, 340, 347, 350.1, 355, 356

(56) References Cited

U.S. PATENT DOCUMENTS 3,769,909 A * 11/1973 Fugman et al. ..... 101/148
4,165,688 A * 8/1979 Leanna et al. ..... 101/207
4,361,089 A * 11/1982 Wittkopf et al. ..... 101/182
4,455,938 A 6/1984 Loudon
4,497,250 A 2/1985 Dressler
5,152,080 A 10/1992 Wimberger
5,481,342 A 1/1996 Arcaro et al.
5,488,905 A 2/1996 Secor
5,808,645 A 9/1998 Reeves et al.
5,979,314 A * 11/1999 White ..... 101/148
5,983,791 A * 11/1999 Wall et al. ..... 101/148

* cited by examiner

*Primary Examiner*—Leslie J. Evanisko
(74) *Attorney, Agent, or Firm*—David J. Archer

(57) ABSTRACT

A seal apparatus is disclosed for sealing dampening solution which is disposed within a reservoir extending from a nip defined between a form roller and a metering roller of a lithographic printing machine. The apparatus includes a source of pressurized air and device for directing a flow of air from the source of pressurized air towards an edge of the reservoir and between the form and metering rollers such that the flow of air generates an air dam for sealing the reservoir so that leakage of the dampening solution from the edge of the reservoir is inhibited.

17 Claims, 6 Drawing Sheets

DAMPENING ASSEMBLY HAVING AIR SEAL APPARATUS FOR SEALING DAMPENING SOLUTION

BACKGROUND OF THE INVENTION

1. Field of the Invention

The present invention relates to a seal apparatus for sealing dampening solution. More specifically, the present invention relates to a seal apparatus for sealing dampening solution which is disposed within a reservoir extending from a nip defined between a form roller and a metering roller of a lithographic printing machine.

2. Information Disclosure Statement

In the lithographic printing art, a form roller and a metering roller are positioned such that the form roller is urged against the metering roller to form a nip therebetween. The form roller includes a cover which may be of rubber. The metering roller also has a cover. The wedge shaped space above the form and metering rollers is filled with dampening solution by means of a constant level filling arrangement. As the form and metering rollers rotate, dampening solution is metered by the nip and is transferred from the surface of the cover of the form roller to a lithographic printing plate secured around the periphery of a rotating plate cylinder. Subsequent to the application of dampening solution to the printing plate, ink is applied to the dampened surface of the printing plate by means of a train of inking rollers which cooperate with an ink fountain. Consequently, due to the prior treatment of the plate, certain portions of the surface of the printing plate will be receptive to the transfer thereto of damping solution and subsequently to the reception of ink. However, other portions of the surface of the plate will be non receptive to such dampening solution and will not therefore take up any dampening solution or any ink. Such hydrophobic portions of the surface of the plate will therefore be devoid of ink. Furthermore, the hydrophilic portions of the surface of the printing plate will be receptive first to the dampening solution and then to the printing ink. Due to the rotation of the plate cylinder, the ink image formed on the plate will be transferred to the surface of a blanket secured to the periphery of a rotating blanket cylinder. As the blanket cylinder rotates, the ink image on the surface of the blanket is transferred to a web of paper extending through a nip defined between the blanket cylinder and a backing roller.

As the form and metering rollers are rotating, dampening solution is transferred by the form roller and is applied to the printing plate secured to the plate cylinder. However, during continued rotation of the form roller in contact with the printing plate, ink particles subsequently applied to the dampened plate will be taken up by the form roller from the printing plate. Such ink particles will mix with the dampening solution. Consequently, during prolonged usage of the printing machine, if such mixture of ink and dampening solution were to leak past the edges of the reservoir, such leakage could spoil an image subsequently transferred to the paper web.

The present invention relates to the provision of air dam seals disposed at the edges of the reservoir for preventing leakage of dampening solution and ink particles.

Therefore, it is a primary feature of the present invention, to provide air dam seals disposed at the edges of a reservoir that overcomes the problems associated with the prior art devices and which make a considerable contribution to the art of lithographic printing.

Another feature of the present invention is the provision of air dam seals which prevent leakage past the edges of a reservoir.

A further feature of the present invention is the provision of air dam seals which permits prolonged usage of the printing setup without marring the quality of the printed product.

Other features and advantages of the present invention will be readily apparent to those skilled in the art by a consideration of the detailed description contained herein with reference to the annexed drawings which show a preferred embodiment of the present invention.

SUMMARY OF THE INVENTION

The present invention relates to a seal apparatus for sealing dampening solution which is disposed within a reservoir extending from a nip defined between a form roller and a metering roller of a lithographic printing machine. The apparatus includes a conduit having a first and a second end, the first end being connected to a source of pressurized air. A nozzle is sealingly connected to the second end of the conduit, the nozzle being located adjacent to an edge of the reservoir. The arrangement is structured such that in use of the apparatus, pressurized air flows from the source of pressurized air through the conduit to the nozzle so that the nozzle directs a flow of air towards the edge of the reservoir and between the form and metering rollers such that the flow of air generates an air dam for sealing the reservoir so that leakage of the dampening solution from the edge of the reservoir is inhibited.

In a more specific embodiment of the present invention, the conduit includes a plastic tube and the plastic tube is flexible.

Also, the nozzle defines a throat which increases the velocity of the flow of air so that the flow of air reliably and predictably impedes leakage of the dampening solution from the edge of the reservoir.

The apparatus further includes a further conduit having a first and a second extremity, the first extremity being connected to the source of pressurized air. A further nozzle is sealingly connected to the second extremity of the further conduit, the further nozzle being located adjacent to a further edge of the reservoir. The further edge of the reservoir is disposed between the form and metering rollers and is spaced axially along the rollers relative to the edge. The arrangement is structured such that in use of the apparatus, pressurized air flows from the source of pressurized air through the conduit to the nozzle so that the nozzle directs a flow of air towards the edge of the reservoir and between the form and metering rollers such that the flow of air generates an air dam for sealing the reservoir so that leakage of the dampening solution from the edge of the reservoir is inhibited.

Additionally, the arrangement is such that pressurized air also flows from the source of pressurized air through the further conduit to the further nozzle so that the further nozzle directs a further flow of air towards the further edge of the reservoir and between the form and metering rollers such that the further flow of air generates a further air dam for sealing the reservoir so that leakage of the dampening solution from the further edge of the reservoir is inhibited.

In another embodiment of the present invention, a wedge shaped seal is disposed between the nozzle and the edge of the reservoir for assisting in the generation of the air dam, the wedge shaped seal diverting the flow of air so that the flow of air flows towards a periphery defined by the wedge shaped seal so that leakage of dampening solution from the reservoir past the periphery of the wedge shaped seal is prevented.

Furthermore, the wedge shaped seal is of cusp shaped configuration, the wedge shaped seal having a point and a first and a second curved surface. The arrangement is such that the point is disposed closely adjacent to the nip defined between the form and metering rollers, the first curved surface being disposed in spaced close proximity to the form roller and the second curved surface is disposed in spaced close proximity to the metering roller.

More specifically, in a preferred embodiment, the wedge shaped seal is fabricated from a plastics material and is adjustably disposed relative to the edge of the reservoir.

Moreover, the wedge shaped seal is disposed spaced from the form and metering rollers so that friction and wear between the wedge shaped seal and adjacent rollers is inhibited.

The wedge shaped seal is disposed between the nozzle and the edge of the reservoir for assisting in the generation of the air dam, the wedge shaped seal diverting the flow of air so that the flow of air flows towards a periphery defined by the wedge shaped seal so that leakage of the dampening solution from the reservoir past the periphery of the wedge shaped seal is prevented. Also, a further wedge shaped seal is disposed between the further nozzle and the further edge of the reservoir for assisting in the generation of the further air dam. The further wedge shaped seal diverts the further flow of air so that the further flow of air flows towards a further periphery defined by the further wedge shaped seal so that leakage of the dampening solution from the reservoir past the further periphery of the further wedge shaped seal is prevented.

The further wedge shaped seal is of cusp shaped configuration, the further wedge shaped seal having a further point and a further first and a second curved surface. The arrangement is such that the further point is disposed closely adjacent to the nip defined between the form and metering rollers. The further first curved surface is disposed in spaced close proximity to the form roller while the further second curved surface is disposed in spaced close proximity to the metering roller.

In a preferred embodiment of the present invention, the further wedge shaped seal is fabricated from a plastics material and is adjustably disposed relative to the further edge of the reservoir.

Also, the further wedge shaped seal is disposed spaced from the form and metering rollers so that friction and wear between the further wedge shaped seal and the adjacent rollers is inhibited.

Many modifications and variations of the present invention will be readily apparent to those skilled in the art by a consideration of the detailed description contained hereinafter. However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
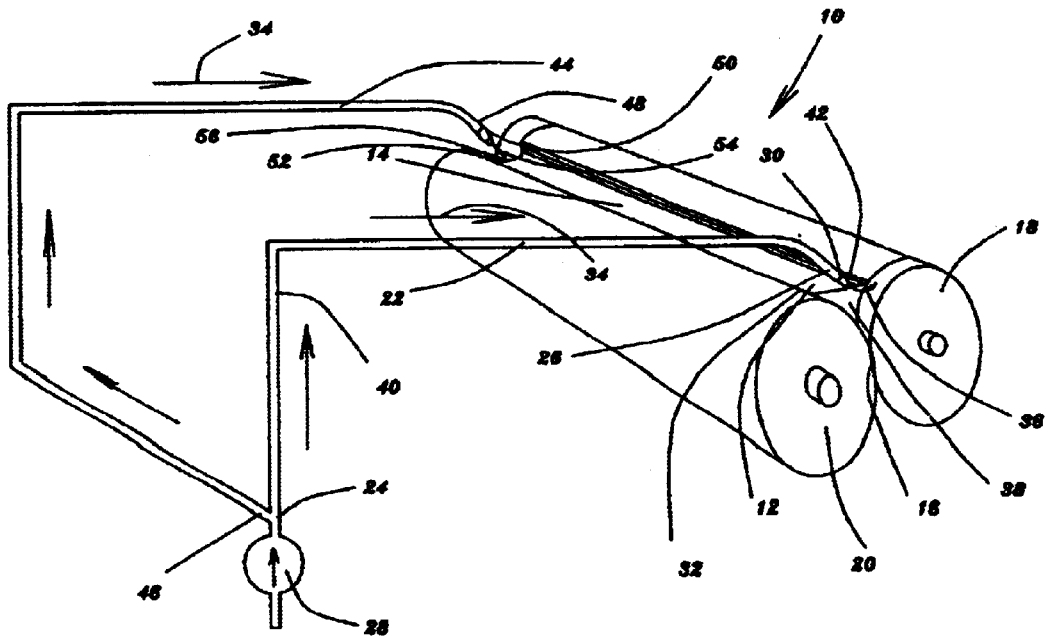
FIG. 1 is a perspective view of a seal apparatus according to the present invention.

FIG. 1 is a perspective view of a seal apparatus generally designated 10 according to the present invention. As shown in FIG. 1, the seal apparatus 10 is used for sealing dampening solution 12 which is disposed within a reservoir 14 extending from a nip 16 defined between a form roller 18 and a metering roller 20 of a lithographic printing machine. The seal apparatus 10 includes a conduit 22 having a first and a second end 24 and 26 respectively, the first end 24 being connected to a source of pressurized air 28. Means such as a nozzle 30 is sealingly connected to the second end 26 of the conduit 22, the nozzle 30 being located adjacent to an edge 32 of the reservoir 14. The arrangement is structured such that in use of the apparatus 10, pressurized air flows as indicated by the arrow 34 from the source of pressurized air 28 through the conduit 22 to the nozzle 30 so that the nozzle 30 directs a flow of air as indicated by the arrow 36 towards the edge 32 of the reservoir 14 and between the form and metering rollers 18 and 20 respectively such that the flow of air 36 generates an air dam 38 for sealing the reservoir 14 so that leakage of the dampening solution 12 from the edge 32 of the reservoir 14 is inhibited.

In a more specific embodiment of the present invention, the conduit 22 includes a plastic tube 40 and the plastic tube 40 is flexible.

Also, the nozzle 30 defines a throat 42 which increases the velocity of the flow of air 36 so that the flow of air 36 reliably and predictably impedes the leakage of the dampening solution 12 sideways from the edge 32 of the reservoir 14.

The apparatus 10 further includes a further conduit 44 having a first and a second extremity, 46 and 48 respectively, the first extremity 46 being connected to the source of pressurized air 28. A further nozzle 50 is sealingly connected to the second extremity 48 of the further conduit 44, the further nozzle 50 being located adjacent to a further edge 52 of the reservoir 14. The further edge 52 is disposed between the form and metering rollers 18 and 20 respectively and spaced axially along the rollers 18 and 20 relative to the edge 32.

Additionally, the arrangement is such that pressurized air 34 also flows from the source of pressurized air 28 through the further conduit 44 to the further nozzle 50 so that the further nozzle 50 directs a further flow of air 54 towards the further edge 52 of the reservoir 14 and between the form and metering rollers 18 and 20 respectively such that the further flow of air 54 generates a further air dam 56 for sealing the reservoir 14 so that leakage of the dampening solution 12 from the further edge 52 of the reservoir 14 is inhibited.

Figure 2:
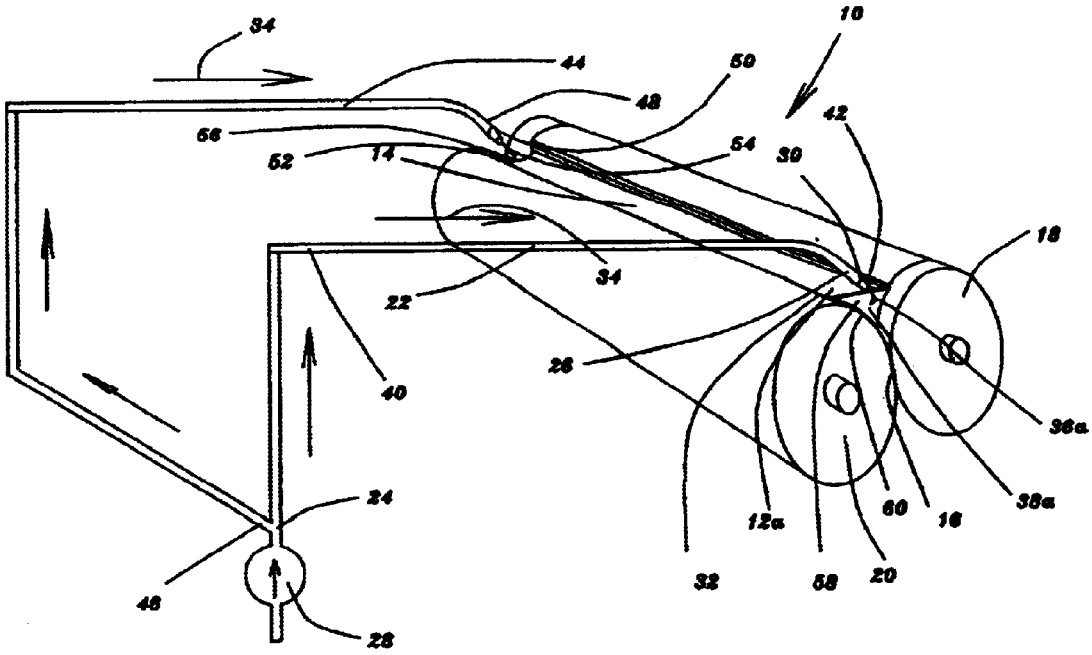
FIG. 2 is a similar view to that shown in FIG. 1 but shows a further embodiment of the present invention.

FIG. 2 is a similar view to that shown in FIG. 1 but shows a further embodiment of the present invention. A wedge shaped seal 58 is disposed between the nozzle 30 and the edge 32 of the reservoir 14 for assisting in the generation of an air dam 38*a*, the wedge shaped seal 58 diverting the flow of air 36*a* so that the flow of air 36*a* flows towards a periphery 60 defined by the wedge shaped seal 58 so that leakage of the dampening solution 12*a* from the reservoir 14 past the periphery 60 of the wedge shaped seal 58 is prevented.

Figure 3:
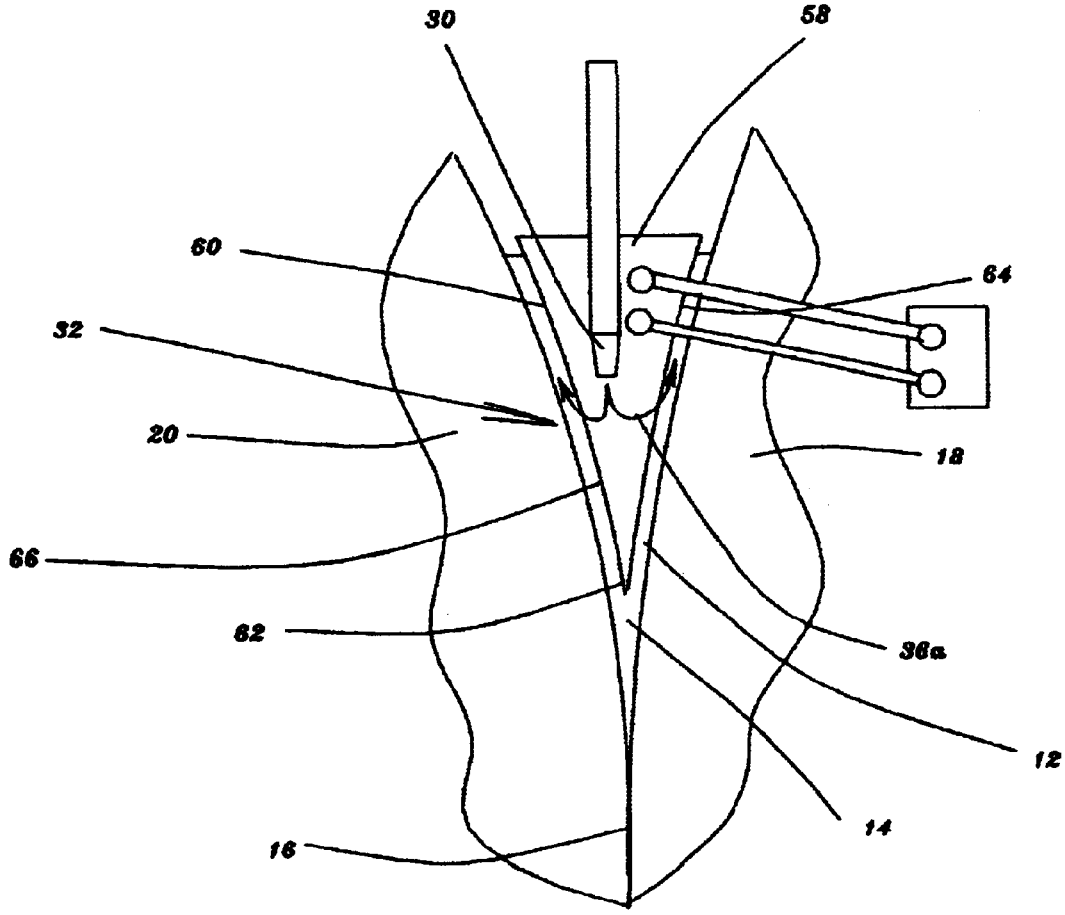
FIG. 3 is an enlarged side elevational view of a wedge shaped seal shown in FIG. 2.

FIG. 3 is an enlarged view of the wedge shaped seal 58 shown in FIG. 2. As shown in FIG. 3, the wedge shaped seal 58 is of cusp shaped configuration, the wedge shaped seal 58 having a point 62 and a first and a second curved surface 64 and 66 respectively. The arrangement is such that the point 62 is disposed closely adjacent to the nip 16 defined between the form and metering rollers 18 and 20 respectively, the first curved surface 64 being disposed in spaced close proximity to the form roller 18 and the second curved surface 66 being disposed in spaced close proximity to the metering roller 20.

More specifically, the wedge shaped seal 58 is fabricated from a plastics material and is adjustably disposed relative to the edge 32 of the reservoir 14.

Moreover, the wedge shaped seal 58 is disposed spaced from the form and metering rollers 18 and 20 respectively so that friction and wear between the wedge shaped seal 58 and the adjacent rollers 18 and 20 is inhibited.

The wedge shaped seal 58 is disposed between the nozzle 30 and the edge 32 of the reservoir 14 for assisting in the generation of the air dam 38*a*, the wedge shaped seal 58 diverting the flow of air 36*a* so that the flow of air 36*a* flows towards the periphery 60 defined by the wedge shaped seal 58 so that leakage of the dampening solution 12 from the reservoir 14 past the periphery 60 of the wedge shaped seal 58 is prevented. The periphery 60 is also shown in FIG. 4.

Figure 4:
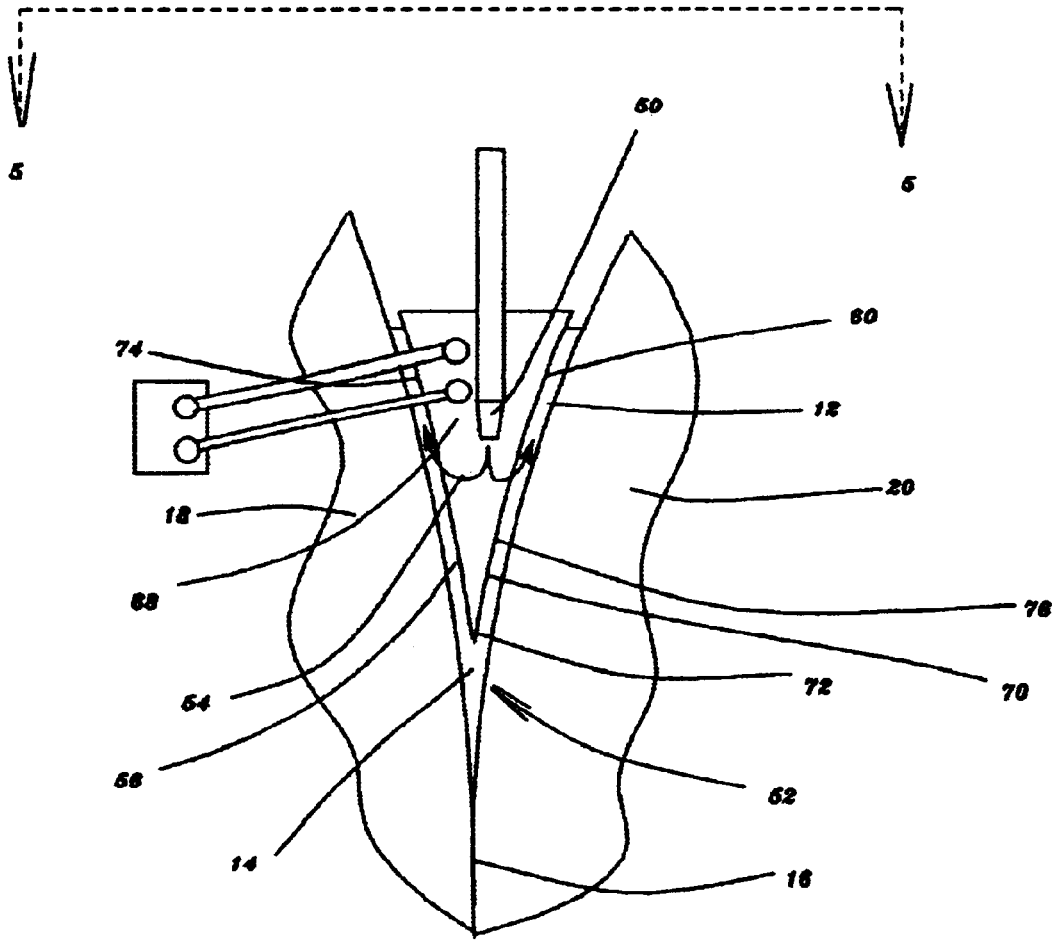
FIG. 4 is a similar view to that shown in FIG. 3 but viewed from the opposite side of the reservoir.

FIG. 4 is a similar view to that shown in FIG. 3 but shows the opposite edge 52 of the reservoir 14. As shown in FIG. 4, a further wedge shaped seal 68 is disposed between the further nozzle 50 and the further edge 52 of the reservoir 14 for assisting in the generation of the further air dam 56. The further wedge shaped seal 68 diverts the further flow of air 54 so that the further flow of air 54 flows towards a further periphery 70 defined by the further wedge shaped seal 68 so that leakage of the dampening solution 12 from the reservoir 14 past the further periphery 70 of the further wedge shaped seal 68 is prevented.

The further wedge shaped seal 68 is also of cusp shaped configuration, the further wedge shaped seal 68 having a further point 72 and a further first and a second curved surface 74 and 76 respectively. The arrangement is such that the further point 72 is disposed closely adjacent to the nip 16 defined between the form and metering rollers 18 and 20 respectively, the further first curved surface 74 being disposed in spaced close proximity to the form roller 18 and the further second curved surface 76 being disposed in spaced close proximity to the metering roller 20.

In a preferred embodiment of the present invention, the further wedge shaped seal 68 is also fabricated from a plastics material and is adjustably disposed relative to the further edge 52 of the reservoir 14.

Figure 5:
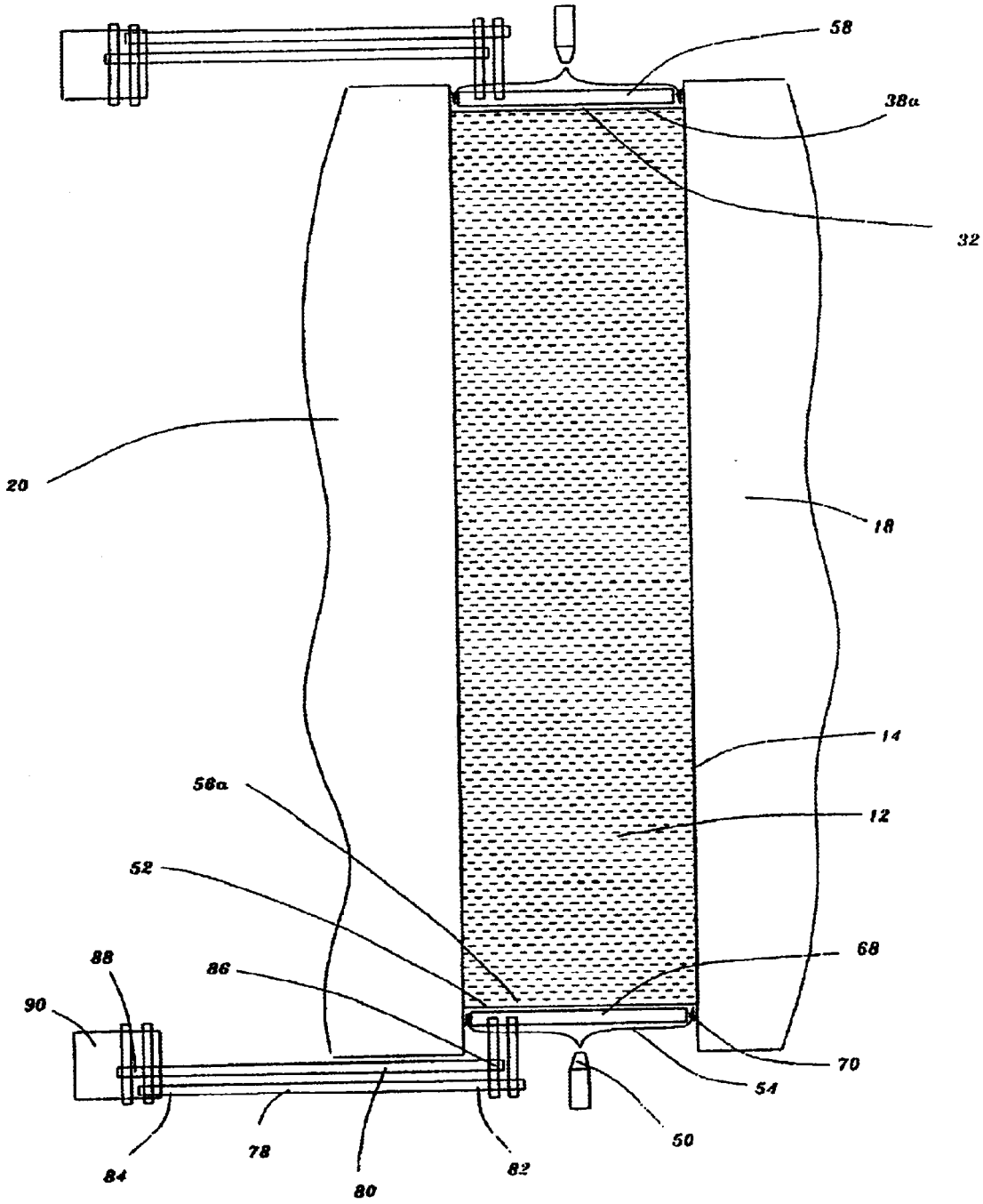
FIG. 5 is a sectional view taken on the line 5—5 of FIG. 4.

FIG. 5 is a sectional view taken on the line 5—5 of FIG. 4. As shown in FIG. 5, the dampening solution 12 is disposed within the reservoir 14 and the further nozzle 50 causes the further flow of air 54 to flow around the further periphery 70 of the further wedge shaped seal 68 to enhance the generation of the further air dam seal 56*a*.

As further shown in FIG. 5, the seal 68 is supported by a first and second arm 78 and 80 respectively which are disposed parallel relative to each other. The first arm 78 has a first and a second end 82 and 84 respectively and the second arm 80 has a first and second extremity 86 and 88 respectively. The first end and first extremity 82 and 86 respectively of the arms 78 and 80 are pivotally secured to the seal 68. Also, the second end and second extremity 84 and 88 respectively of the arms 78 and 80 are pivotally secured to a support block 90 which is rigidly secured to a framework of the printing machine. A similar arrangement of parallel arms supports the wedge shaped seal 58 as shown in FIGS. 3 and 5. Accordingly, the wedge shaped seals 58 and 68 are able to be accurately located between the rollers 18 and 20 in order to minimize wear while permitting a flow of air around the periphery thereof to generate the air dams 38*a* and 56*a*.

The further wedge shaped seal 68 is disposed spaced from the form and metering rollers 18 and 20 so that friction and wear between the further wedge shaped seal 68 and adjacent rollers 18 and 20 is inhibited.

Figure 6:
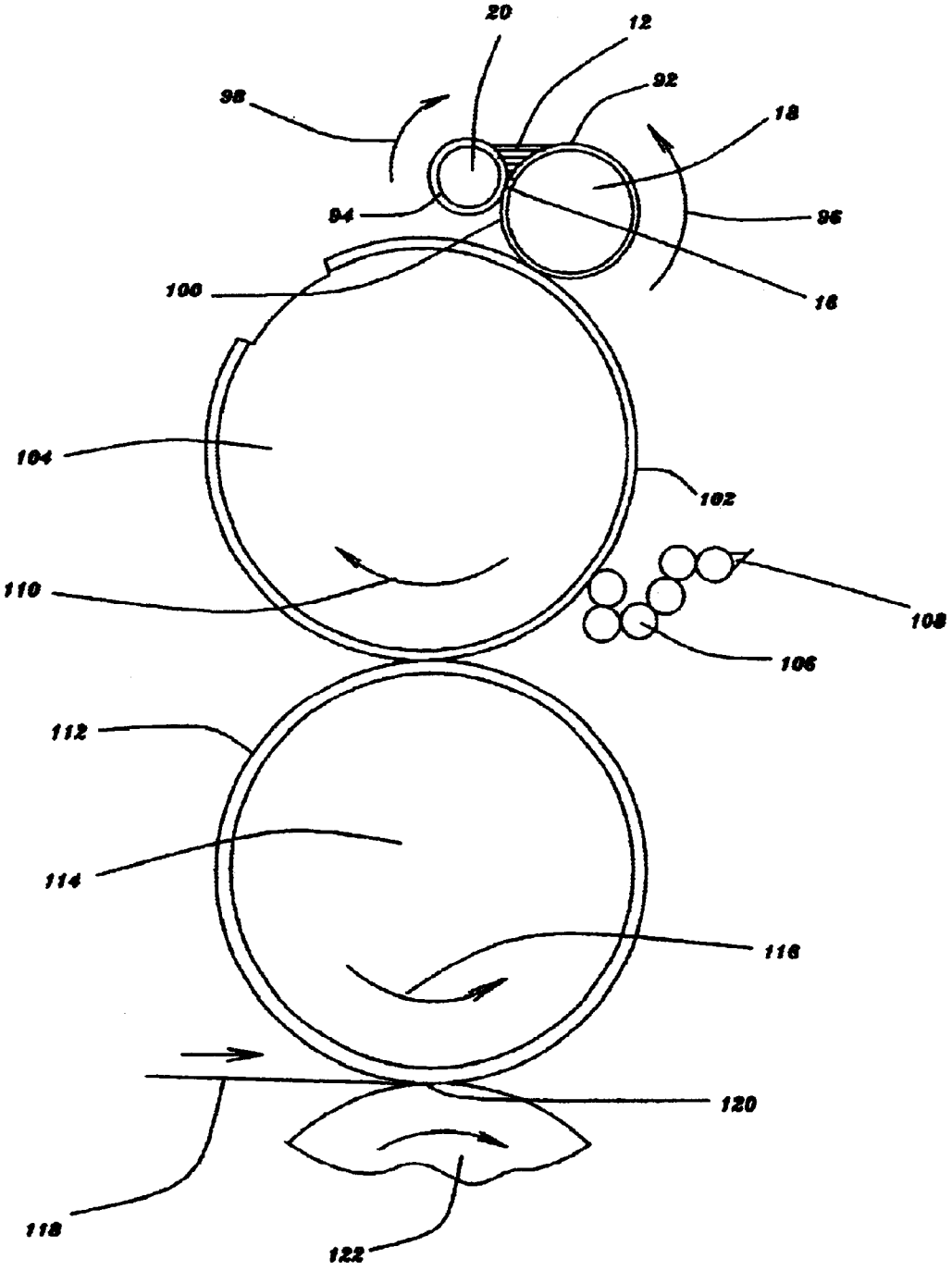
FIG. 6 is a side elevational view of a typical lithographic printing machine incorporating the the air dam seal arrangement according to the present invention.

FIG. 6 is a side elevational view of a typical lithographic printing machine incorporating the the air dam seal arrangement according to the present invention. As shown in FIG. 6, the form and metering rollers 18 and 20 are positioned such that the form roller 18 is urged against the metering roller 20 to form a nip 16 therebetween. The form roller 18 includes a cover 92 which may be of rubber having a hardness of 55 Durometer. The metering roller 20 also has a cover 94 which may have a hardness of 100 Durometer. The wedge shaped space above the rollers 18 and 20 is filled with dampening solution 12 by means of a constant level filling arrangement (not shown) which is well known to those skilled in the printing art. As the rollers 18 and 20 rotate as indicated by the arrows 96 and 98 respectively, dampening solution 12 is metered by the nip 16 and is transferred from the surface 100 of the cover 92 to a lithographic printing plate 102 secured around the periphery of a plate cylinder 104. Subsequent to the application of dampening solution 12 to the printing plate 102, ink is applied to the dampened surface of the printing plate 102 by means of a train of inking rollers 106 which cooperate with an ink fountain 108 as is well known in the art. Consequently, due to the prior treatment of the plate 102, certain portions of the surface will be receptive to the transfer thereto of damping solution and subsequently to the reception of ink. However, other portions of the surface of the plate 102 will be non receptive to such dampening solution 12 and will not therefore take up any dampening solution 12 or any ink. Such hydrophobic portions of the surface of the plate 102 will therefore be devoid of ink. Furthermore, the hydrophilic portions of the surface of the printing plate will be receptive first to the dampening solution and then to the printing ink. Due to the rotation of the plate cylinder 104, as indicated by the arrow 110, the ink image formed on the plate 102 will be transferred to the surface of a blanket 112 secured to the periphery of a blanket cylinder 114. As the blanket cylinder rotates as indicated by the arrow 116, the ink image on the surface of the blanket 112 is transferred to a web or sheets of paper 118 which extends through nip 120 defined between the blanket cylinder 114 and a backing roller 122.

The air dam arrangement of the present invention as shown in FIGS. 1–6, prevents leakage of dampening solution from the edges 32 and 52 of the reservoir 14 as shown particularly in FIG. 5.

In operation of the device according to the present invention, when the rollers 18 and 20 are rotating, dampening solution 12 is applied to the plate 102 by the form roller 18. However, during continued rotation of the form roller 18 in contact with the printing plate 102, ink particles will be taken up by the form roller 18 from the plate 102. Such ink particles will mix with the dampening solution 12. Consequently, during prolonged usage of the printing machine, if such mixture of ink and dampening solution were to leak past the edges 32 and 52, shown in FIG. 5, of the reservoir 14, such leakage could spoil the image transferred to the paper web 118. Therefore, by the provision of the air dam seals 38 and 56 according to the present invention, such leakage is prevented and prolonged usage of the printing setup can be maintained without marring the quality of the printed product.

What is claimed is:

1. A dampener assembly, in combination with a seal apparatus for sealing dampening solution, comprising:

a rotatable form roller and a rotatable metering roller located adjacent one another and defining a nip therebetween;

a reservoir of dampening solution disposed above the nip defined between the form roller and metering roller; the form roller and metering roller each being rotatable in a direction from the reservoir towards the nip;

the seal apparatus including: a conduit having a first and a second end, said first end being connected to a source of pressurized air; and a nozzle sealingly connected to said second end of said conduit, said nozzle being located adjacent to an edge of the reservoir, the seal apparatus being structured such than in use of the dampener assembly, pressurized air flows from the source of pressurized air through said conduit to said nozzle so that said nozzle directs a flow of air towards the edge of the reservoir and between the form and metering rollers such that said flow of air generates an air dam for sealing the reservoir so that leakage of dampening solution from the edge of the reservoir is inhibited.

2. A seal apparatus as set forth in claim 1 wherein said nozzle defines a throat which increases the velocity of said flow of air so that said flow of air reliably and predictably impedes said leakage of the dampening solution from the edge of the reservoir.

3. A seal apparatus as set forth in claim 1 wherein said conduit includes:

a plastic tube.

4. A seal apparatus as set forth in claim 3 wherein said plastic tube is flexible.

5. A seal apparatus as set forth in claim 1 further including:

a further conduit having a first and a second extremity, said first extremity being connected to said source of pressurized air;

a further nozzle sealingly connected to said second extremity of said further conduit, said further nozzle being located adjacent to a further edge of the reservoir, the further edge being disposed between the form and metering rollers and spaced axially along the rollers relative to the edge, the arrangement being structured such that in use of the apparatus, pressurized air also flows from the source of pressurized air through said further conduit to said further nozzle so that said further nozzle directs a further flow of air towards the further edge of the reservoir and between the form and metering rollers such that said further flow of air generates a further air dam for sealing the reservoir so that leakage of the dampening solution from the further edge of the reservoir is inhibited.

6. A seal apparatus as set forth in claim 5 further including:

a wedge shaped seal disposed between said nozzle and the edge of the reservoir for assisting in said generation of said air dam, said wedge shaped seal diverting said flow of air so that said flow of air flows towards a periphery defined by said wedge shaped seal so that leakage of the dampening solution from the reservoir past said periphery of said wedge shaped seal is prevented;

a further wedge shaped seal disposed between said further nozzle and the further edge of the reservoir for assisting in said generation of said further air dam, said further wedge shaped seal diverting said further flow of air so that said further flow of air flows towards a further periphery defined by said further wedge shaped seal so that leakage of the dampening solution from the reservoir past said further periphery of said further wedge shaped seal is prevented.

7. A seal apparatus as set forth in claim 6 wherein said further wedge shaped seal is fabricated from a plastics material.

8. A seal apparatus as set forth in claim 6 wherein said further wedge shaped seal is adjustably disposed relative to the further edge of the reservoir.

9. A seal apparatus as set forth in claim 6 wherein said further wedge shaped seal is disposed spaced from the form and metering rollers so that friction and wear between said further wedge shaped seal and adjacent rollers is inhibited.

10. A seal apparatus as set forth in claim 1 further including:

a wedge shaped seal disposed between said nozzle and the edge of the reservoir for assisting in said generation of said air dam, said wedge shaped seal diverting said flow of air so that said flow of air flows towards a periphery defined by said wedge shaped seal so that leakage of the dampening solution from the reservoir past said periphery of said wedge shaped seal is prevented.

11. A seal apparatus as set forth in claim 10 wherein said wedge shaped seal is disposed spaced from the form and metering rollers so that friction and wear between said wedge shaped seal and adjacent rollers is inhibited.

12. A seal apparatus as set forth in claim 10 wherein said wedge shaped seal is fabricated from a plastics material.

13. A seal apparatus as set forth in claim 10 wherein said wedge shaped seal is adjustably disposed relative to the edge of the reservoir.

14. A seal apparatus for sealing dampening solution which is disposed within a reservoir extending from a nip defined between a form roller and a metering roller of a lithographic printing machine, said apparatus comprising:

a conduit having a first and a second end, said first end being connected to a source of pressurized air;

a nozzle sealingly connected to said second end of said conduit, said nozzle being located adjacent to an edge of the reservoir, the nozzle and conduit being structured such that in use of the apparatus, pressurized air flows from the source of pressurized air through said conduit to said nozzle so that said nozzle directs a flow of air towards the edge of the reservoir and between the form and metering rollers such that said flow of air generates an air dam for sealing the reservoir so that leakage of the dampening solution from the edge of the reservoir is inhibited;

a wedge shaped seal disposed between said nozzle and the edge of the reservoir for assisting in said generation of said air dam, said wedge shaped seal diverting said flow of air so that said flow of air flows towards a periphery defined by said wedge shaped seal so that leakage of the dampening solution from the reservoir past said periphery of said wedge shaped seal is prevented; and said wedge shaped seal is of cusp shaped configuration, said wedge shaped seal having a point and a first and a second curved surface, the wedge shaped seal being such that said point is disposed closely adjacent to the nip defined between the form and metering rollers, said first curved surface being disposed in spaced close proximity to the form roller and said second curved surface being disposed in spaced close proximity to the metering roller.

15. A seal apparatus for sealing dampening solution which is disposed within a reservoir extending from a nip defined between a form roller and a metering roller of a lithographic printing machine, said apparatus comprising:

a conduit having a first and a second end, said first end being connected to a source of pressurized air;

a nozzle sealingly connected to said second end of said conduit, said nozzle being located adjacent to an edge of the reservoir, the nozzle and conduit being structured such that in use of the apparatus, pressurized air flows from the source of pressurized air through said conduit to said nozzle so that said nozzle directs a flow of air towards the edge of the reservoir and between the form and metering rollers such that said flow of air generates an air dam for sealing the reservoir so that leakage of the dampening solution from the edge of the reservoir is inhibited;

a further conduit having a first and a second extremity, said first extremity being connected to said source of pressurized air;

a further nozzle sealingly connected to said second extremity of said further conduit, said further nozzle being located adjacent to a further edge of the reservoir, the further edge being disposed between the form and metering rollers and spaced axially along the rollers relative to the edge, the further nozzle and further conduit being structured such that in use of the apparatus, pressurized air flows from the source of pressurized air through said conduit to said nozzle so that said nozzle directs a flow of air towards the edge of the reservoir and between the form and metering rollers such that said flow of air generates an air dam for sealing the reservoir so that leakage of the dampening solution from the edge of the reservoir is inhibited and such that pressurized air also flows from the source of pressurized air through said further conduit to said further nozzle so that said further nozzle directs a further flow of air towards the further edge of the reservoir and between the form and metering rollers such that said further flow of air generates a further air dam for sealing the reservoir so that leakage of the dampening solution from the further edge of the reservoir is inhibited;

a wedge shaped seal disposed between said nozzle and the edge of the reservoir for assisting in said generation of said air dam, said wedge shaped seal diverting said flow of air so that said flow of air flows towards a periphery defined by said wedge shaped seal so that leakage of the dampening solution from the reservoir past said periphery of said wedge shaped seal is prevented;

a further wedge shaped seal disposed between said further nozzle and the further edge of the reservoir for assisting in said generation of said further air dam, said further wedge shaped seal diverting said further flow of air so that said further flow of air flows towards a further periphery defined by said further wedge shaped seal so that leakage of the dampening solution from the reservoir past said further periphery of said further wedge shaped seal is prevented; and said further wedge shaped seal is of cusp shaped configuration, said further wedge shaped seal having a further point and a further first and a second curved surface, the further wedge shaped seal being such that said further point is disposed closely adjacent to the nip defined between the form and metering rollers, said further first curved surface being disposed in spaced close proximity to the form roller and said further second curved surface being disposed in spaced close proximity to the metering roller.

16. A dampener assembly, in combination with a seal apparatus for sealing dampening solution, comprising:

a rotatable form roller and a rotatable metering roller located adjacent one another and defining a nip therebetween;

a reservoir of dampening solution disposed above the nip defined between the form roller and metering roller; the form roller and metering roller each being rotatable in a direction from the reservoir towards the nip;

the seal apparatus including: a conduit having a first and a second end, said first end being connected to a source of pressurized air; a nozzle sealingly connected to said second end of said conduit, said nozzle being located adjacent to an edge of the reservoir, the seal apparatus being structured such than in use of the dampener assembly, pressurized air flows from the source of pressurized air through said conduit to said nozzle so that said nozzle directs a flow of air towards the edge of the reservoir and between the form and metering rollers such that said flow of air generates an air dam for sealing the reservoir so that leakage of dampening solution from the edge of the reservoir is inhibited, and a seal disposed between the nozzle and the edge of the reservoir for assisting in said generation of said air dam, said seal diverting said flow of air so that said flow of air flows towards a periphery defined by said seal so that leakage of the dampening solution from the reservoir past said periphery of said seal is prevented.

17. A dampener assembly, in combination with a seal apparatus for sealing dampening solution, comprising:

a rotatable form roller and a rotatable metering roller located adjacent one another and defining a nip therebetween;

a reservoir of dampening solution disposed above the nip defined between the form roller and metering roller; the form roller and metering roller each being rotatable in a direction from the reservoir towards the nip;

the seal apparatus including: a conduit having a first and a second end, said first end being connected to a source of pressurized air; a nozzle sealingly connected to said second end of said conduit, said nozzle being located adjacent to an edge of the reservoir, the seal apparatus being structured such than in use of the dampener assembly, pressurized air flows from the source of pressurized air through said conduit to said nozzle so that said nozzle directs a flow of air towards the edge of the reservoir and between the form and metering rollers such that said flow of air generates an air dam for sealing the reservoir so that leakage of dampening solution from the edge of the reservoir is inhibited, and a seal disposed between the nozzle and the edge of the reservoir and being adjustably disposed relative to the edge of the reservoir for assisting in said generation of said air dam, said seal diverting said flow of air so that said flow of air flows towards a periphery defined by said seal so that leakage of the dampening solution from the reservoir past said periphery of said seal is prevented.

* * * * *